US005975276A

United States Patent [19]

Yeh

[11] Patent Number: 5,975,276

[45] Date of Patent: Nov. 2, 1999

[54] COMPARATIVE TYPE DETECTING MEANS FOR A COIN-COLLECTING MECHANISM

[76] Inventor: Young-Chin Yeh, 2F, No. 70, Wu Hua Street, San Chuong City, Taipei Hsien, Taiwan

[21] Appl. No.: 09/009,876

[22] Filed: Jan. 21, 1998

[51] Int. Cl.[6] ..... G07D 5/02

[52] U.S. Cl. ..... 194/317; 194/334

[58] Field of Search ..... 194/317, 318, 194/319, 334, 338; 453/4

[56] References Cited

U.S. PATENT DOCUMENTS

| | | | |
|---|---|---|---|
| 5,226,520 | 7/1993 | Parker | 194/317 |
| 5,433,310 | 7/1995 | Bell | 194/318 |
| 5,662,205 | 9/1997 | Levasseur | 194/317 |
| 5,697,484 | 12/1997 | Yeh | 194/318 |

*Primary Examiner*—F. J. Bartuska

*Attorney, Agent, or Firm*—Bacon & Thomas

[57] ABSTRACT

Disclosed is a comparative type detector for a coin-collecting mechanism. The comparative type detector includes a movable slot way portion having parallelly arranged and downward open first and second slot ways, as well as a main slide way and a secondary slide way located below and aligned with the first and the second slot ways, respectively. The second slot way and the secondary slide way together define a space for positioning a sample coin therein, and the first slot way and the main slide way together define a passage for a coin inserted into the coin-collecting mechanism to pass therethrough. Electric eyes are fixedly mounted at front and rear ends of the first slot way respectively slightly higher and lower than a reference line which is defined by a line parallel to a bottom surface of the secondary slide way and tangent to a top point of the sample coin. The distance between the electric eyes and the reference line determines the tolerance in examining diametrical size of an inserted coin compared to the sample coin.

4 Claims, 7 Drawing Sheets

+8V
1K
4.3V
47U
VCC
U?A
LM358
+5V
COIN DET.
LM393
R?
RESISTOR
VAR
2.7M
C?
1U
1N4148
D?
1N4148
LM393
10K
R?
22K
C?
.1
IR3
IR4
IR2
IR1
PT3
PT4
PT2
PT1
1K
10K
.1
U?A
IC#4
IC#3
IC#2
IC#5
N400
CON4
+12V
C945
C945
U2
VDD
RST
OSC1
OSC2
GND
PA0
PA1
PA2
PA3
PA4
PA5
PA6
PA7
PB0
PC0
PC1
HT48100-16D
100K
BEEP OUT
R?
Y?
CRYSTAL
1N4001
1U/
16V
1/2W
100U
270
D?
DIODE
ZENER1
100 1W
8V
220U

COMPARATIVE TYPE DETECTING MEANS FOR A COIN-COLLECTING MECHANISM

BACKGROUND OF THE INVENTION

The present invention relates to comparative type detecting means for a coin-collecting mechanism, and more particularly to comparative type detecting means which includes not only electromagnetic induction means to accurately examine the material of the coin inserted into the coin-collecting mechanism but also electric eyes to accurately check the diametrical size of the inserted coin. The present invention is an improvement made to an earlier invention of the applicant titled "ELECTRONIC COIN-COLLECTING MECHANISM" which has been granted a patent under U.S. Pat. No. 5,697,484 on Dec. 16, 1997.

A coin-collecting mechanism must be able to examine the correctness of a coin inserted into it. More particularly, the coin-collecting mechanism must be able to check the inserted coins for their correct material and size or diameter, lest the mechanism should be cheated to cause any loss.

In most currently available coin-collecting mechanism, the detection of any coin with incorrect diametrical size is done by means consisting of a coil and a high-frequency circuit. The high frequency will change with the temperature and will therefore have influence on the accuracy of the examination. Moreover, such detective means requires high manufacturing cost and is not economical if it is used to examine only one type of coin.

Another conventional way for checking the correct diametrical size of a coin inserted into a coin-collecting mechanism is to mount a row of electric eyes on a fixed coin slide way in the coin-collecting mechanism to detect any coin with incorrect diametrical size. Since the coin slide way is fixedly provided in the coin-collecting mechanism, the electric eyes mounted thereon also have fixed positions and are not movable. Under this condition, the electric eyes can only be used to identify a preset coin size. In other words, when the coin-collecting mechanism has been set to collect coins of a certain size, the positions of electric eyes on the coin slide way are decided at the same time. The detecting means, that is, the electric eyes of the coin-collecting mechanism can only accurately detect coin that does not meet the preset coin size. The use of the coin-collecting mechanism is therefore largely limited. FIG. 1 is a perspective showing the above-described detecting means. When the coin to be collected by the coin-collecting mechanism is changed, the whole detecting means, including the electric circuits thereof, in the mechanism must also be changed. To do so, a considerably high cost is required and will adversely affect the market.

Currently, the most popular detecting means for coin-collecting mechanism is a comparative type detecting means as shown in FIGS. 2, 3 and 4. This comparative type detecting means 1 mainly includes a movable slot way portion 2. Inside the movable slot way portion 2, there are three inductance coils. Two parallelly arranged and downward open slot ways, namely, a first slot way 21 and a second slot way 22 are formed at a lower part of the slot way portion 2. The first and the second slot way 21, 22 respectively aligns with a main slide way 11 and a secondary slide way 12 located below them in the coin-collecting mechanism. With the aid of other component, such as a spring, the whole slot way portion 2 maybe pivotally moved up or down relative to the main and the secondary slide ways 11, 12. A selected sample coin is disposed between the second slot way 22 and the secondary slide way 12. Under the action of electromagnetic induction of the inductance coils inside the movable slot way portion 2, a coin inserted into the coin-collecting mechanism and passing between the first slot way 21 and the main slide way 11 will be compared to the sample coin between the second slot way 22 and the secondary slide way 12. Only a coin exactly the same as the sample coin is allowed to pass through the first slot way 21 and the main slide way 11.

In the event the coin for the coin-collecting mechanism is to be changed, for example, from a smaller coin to a bigger coin, simply remove the previous sample coin from the second slot way 22 and the secondary slide way 12 and replace it with a newly selected sample coin. The detecting mechanism of the coin-collecting mechanism can then function with a new detection standard defined by the new sample coin. Thereafter, only coins the same as the new sample coin are allowed to pass the first slot way 21 and the main slide way 11 to enable a coin-operated machine associated with the coin-collecting mechanism.

According to tests, the above-described comparative type detecting means performs well to accurately detect coin with incorrect material but fails to accurately detect coin with incorrect diametrical size. That is, a true coin having different diametrical size from the sample coin may still be allowed to pass the coin examination, forming a dead corner in the detection.

In brief, the above-described comparative type detecting means for a coin-collecting mechanism is perfect for detecting incorrect coin material and is economically advantageous because it allows the same coin-collecting mechanism to be easily adjusted to accept a differently sized sample coins. However, the same detecting means is not able to accurately detect coins in incorrect diametrical size.

It is therefore tried by the inventor to develop an improved comparative type detecting mechanism for a coin-collecting mechanism which maintains the advantages of the conventional comparative type detecting mechanism for coin-collecting mechanism and provides enhanced ability of detecting coin in incorrect diametrical size.

SUMMARY OF THE INVENTION

A primary object of the present invention is to provide a comparative type detecting means for a coin-collecting mechanism. The comparative type detecting means includes a movable slot way portion having parallelly arranged first and second slot ways as well as a main slide way and a secondary slide way located below and aligned with the first and the second slot ways, respectively. The second slot way and the secondary slide way together define a space for positioning a sample coin therein, and the first slot way and the main slide way together define a passage for a coin inserted into the coin-collecting mechanism to pass therethrough. Electric eyes are fixedly mounted at front and rear ends of the first slot way slightly higher and lower, respectively, than a reference line which is defined by a line parallel to a bottom surface of said secondary slide way and tangent to a top point of said sample coin. The distance between the electric eyes and the reference line determines the tolerance in examining the diametrical size of an inserted coin compared to the sample coin. The electric eye at front end of the first slot way is preferably higher than the reference line by 0.25 mm to 0.4 mm, and the electric eye at rear end of the first slot way is preferably lower than the reference line by 0.25 mm to 0.4 mm. These distances determine the tolerance in examining diametrical size of an inserted coin compared to the sample coin. Since the electric eyes of the comparative type detecting means are fixedly mounted on the first slot way of the movable slot way portion of the coin-collecting mechanism, they can move up or down along with the movable slot way portion. Whereby, the comparative type detecting means of the present invention allows the coin-collecting mechanism to accurately detect not only coin with different material but also coin with different diametrical size. The coin-collecting mechanism is therefore functionally upgraded.

DETAILED DESCRIPTION OF THE PREFERRED EMBODIMENT

Figure 1:
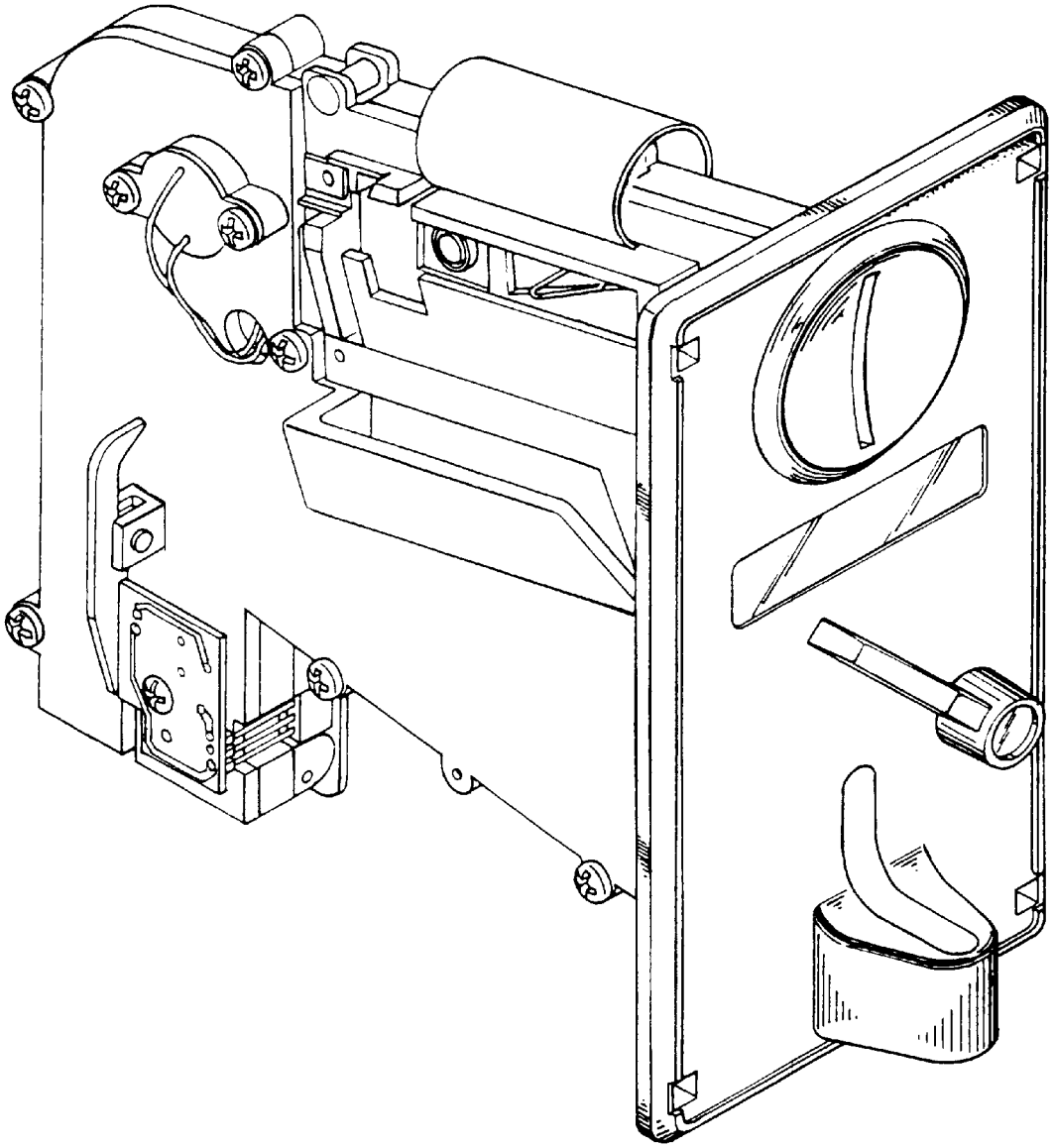
FIG. 1 (prior art)
FIG. 1 is a perspective of a conventional detecting means for a coin-collecting mechanism applicable to only one size of coin.
Figure 2:
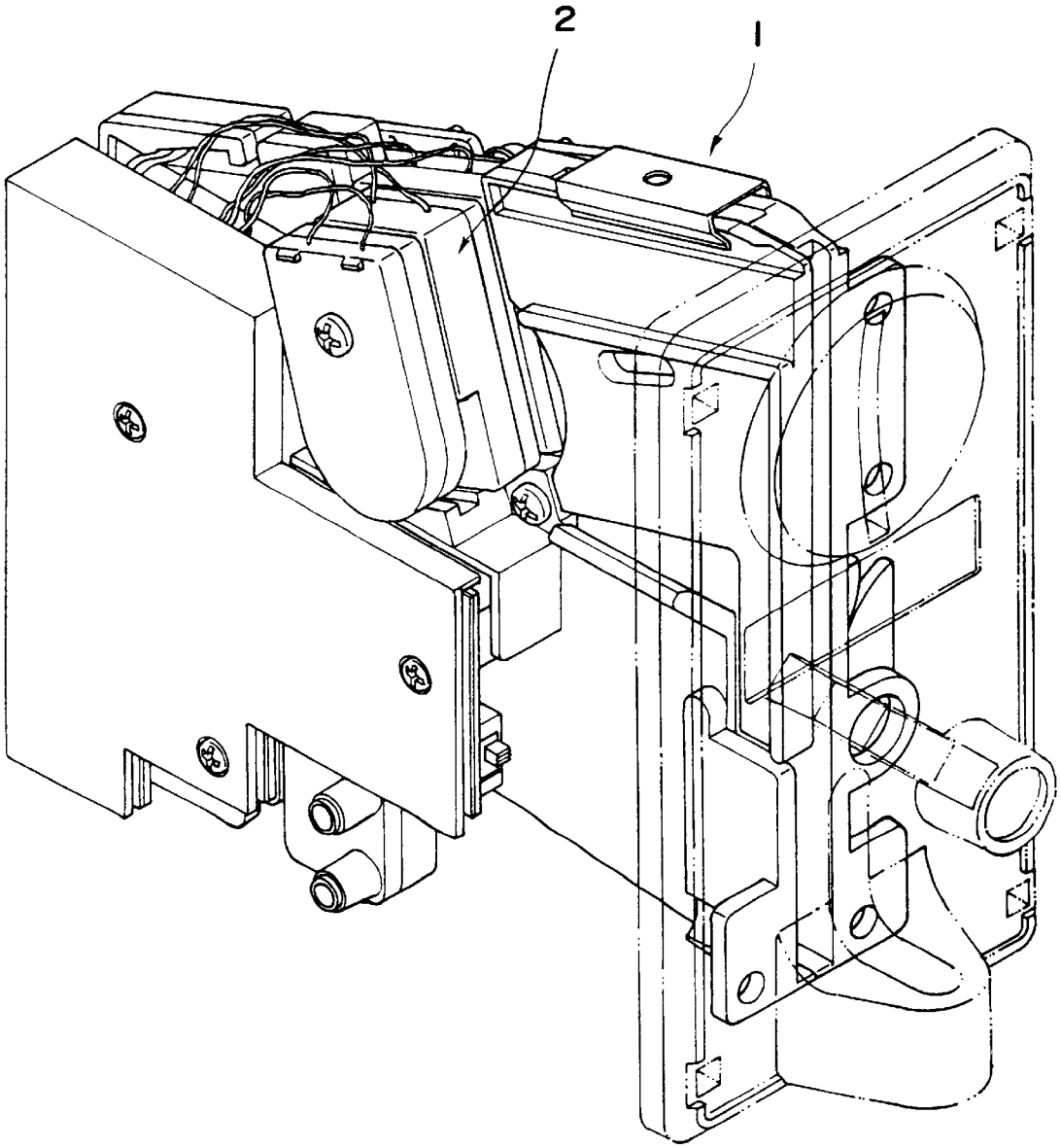
FIG. 2 (prior art)
FIG. 2 is a left side perspective view of a conventional comparative type detecting means for a coin-collecting mechanism applicable to differently sized coins.
Figure 3:
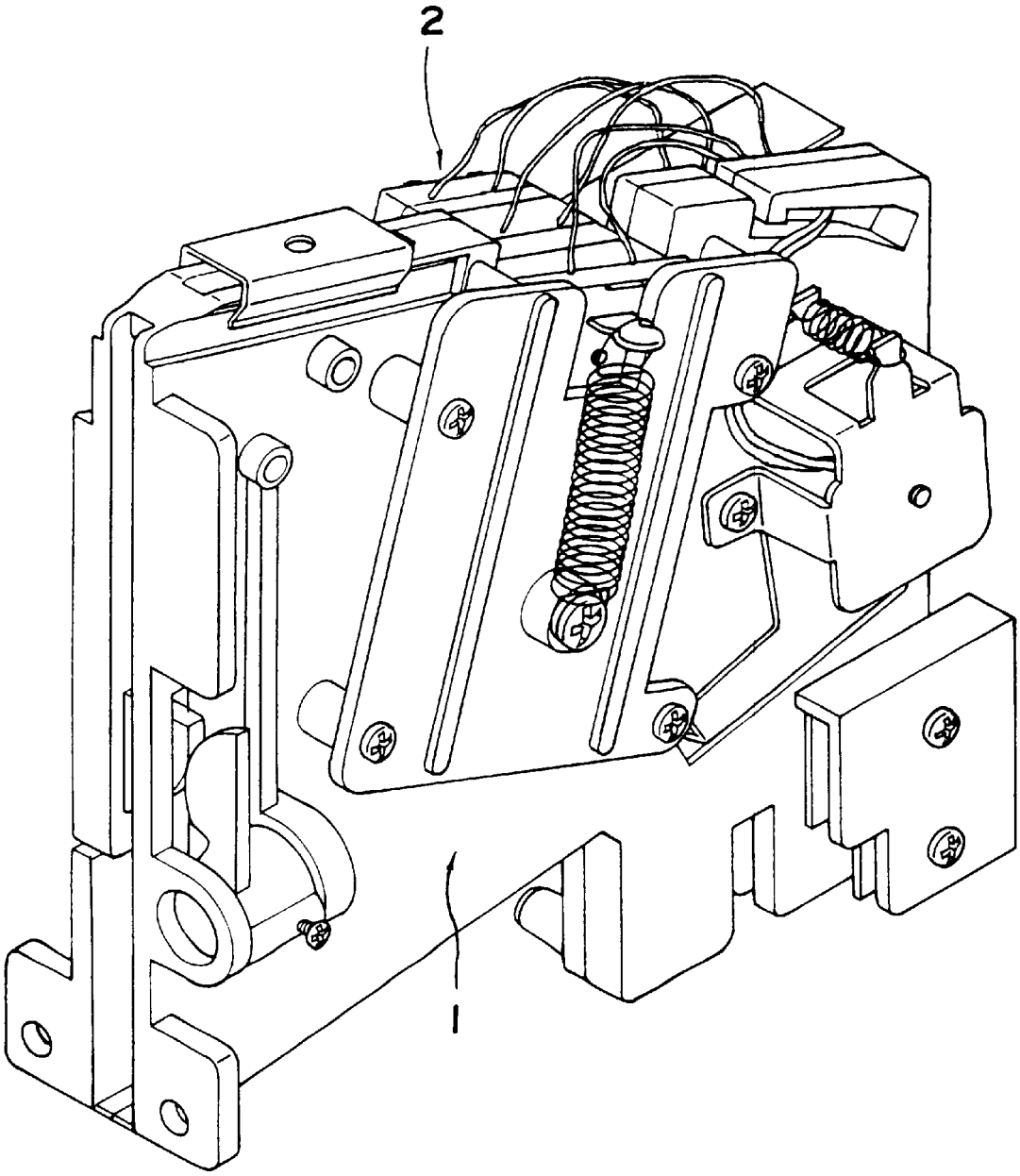
FIG. 3 (prior art)
FIG. 3 is a right side perspective view of the comparative type detecting means of FIG. 2.
Figure 4:
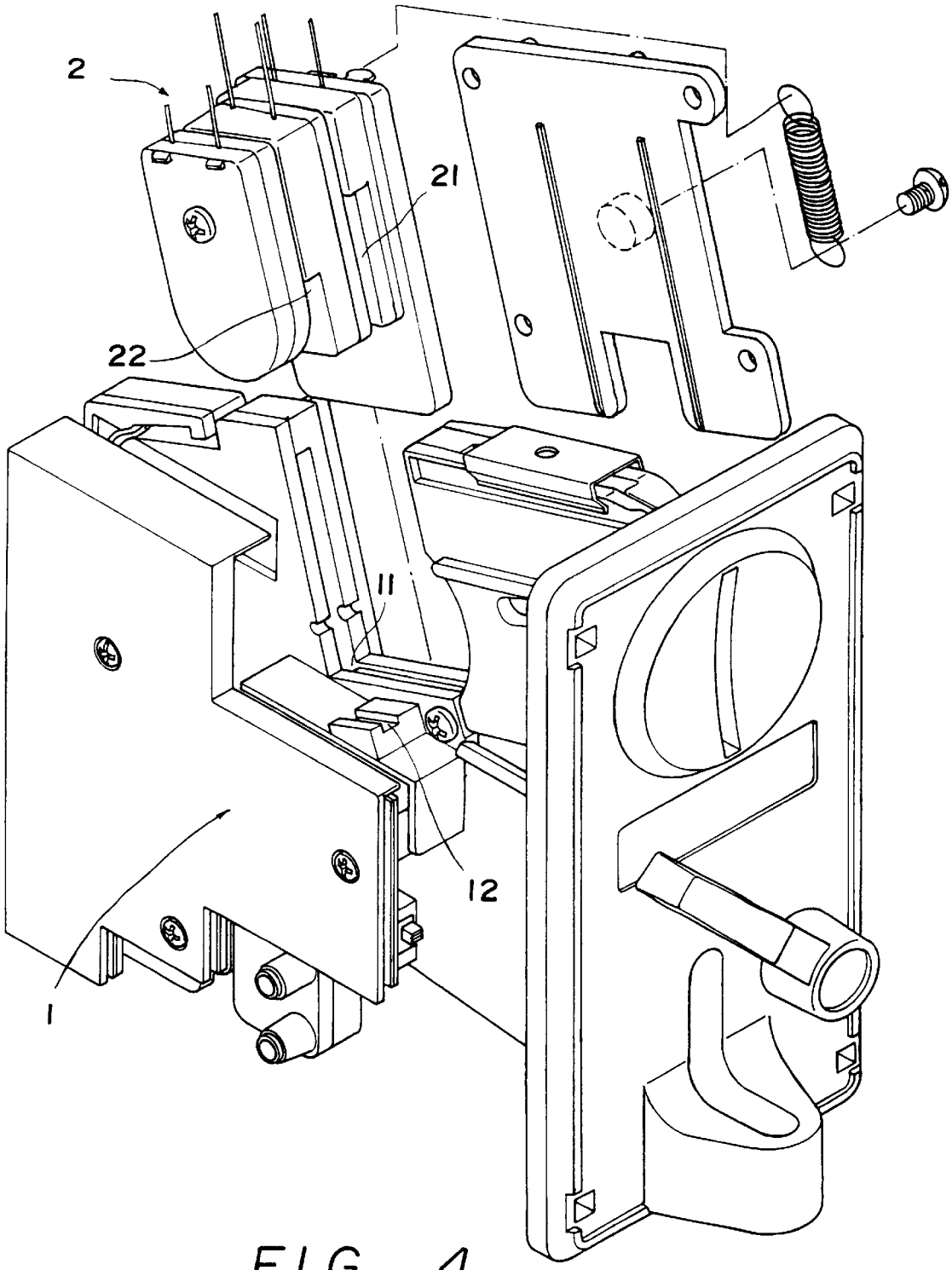
FIG. 4 (prior art)
FIG. 4 is an exploded perspective of the comparative type detecting means shown in FIGS. 2 and 3.
Figure 6:
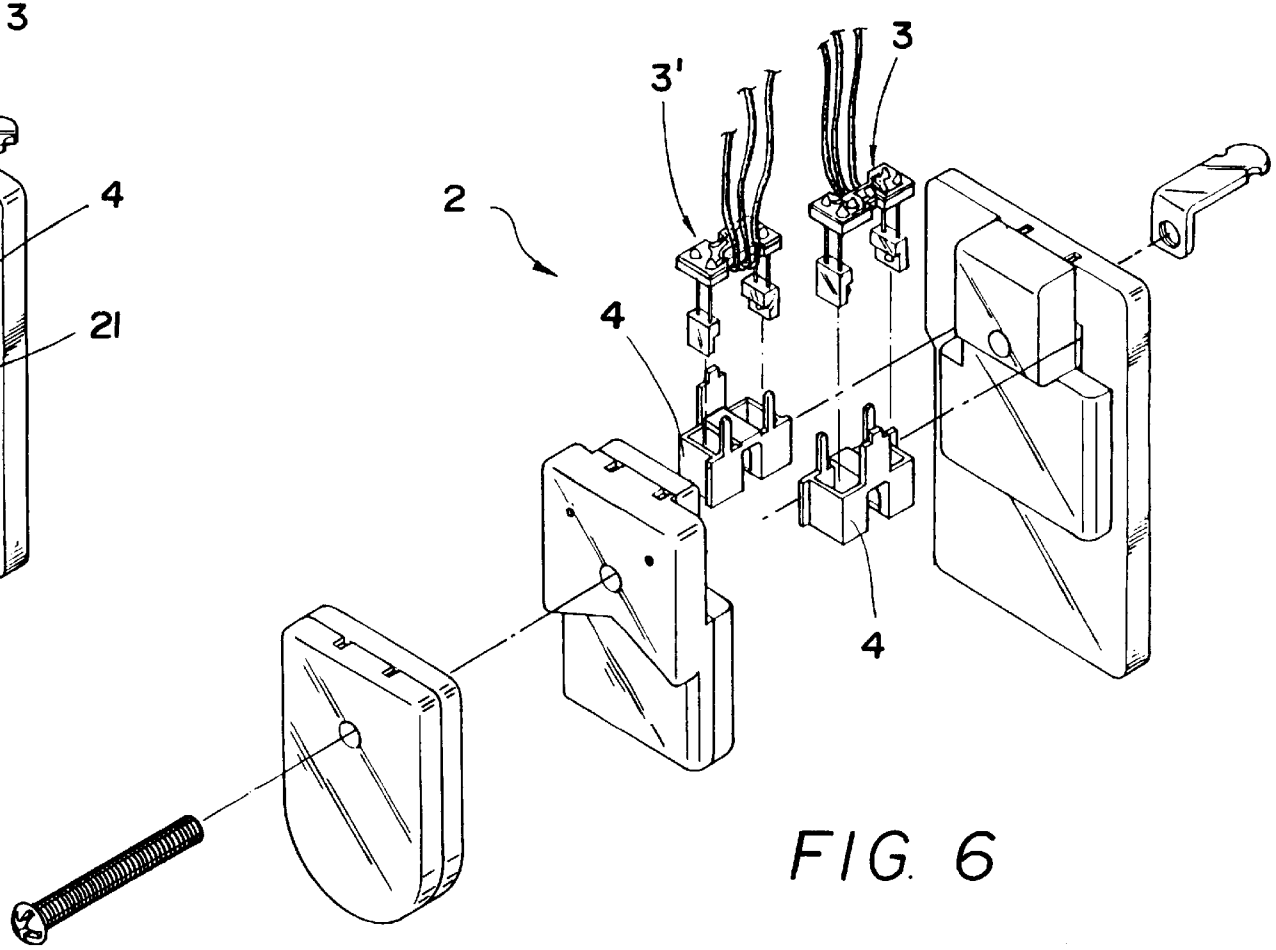
FIG. 6 is an exploded perspective of the present invention.
Figure 5:
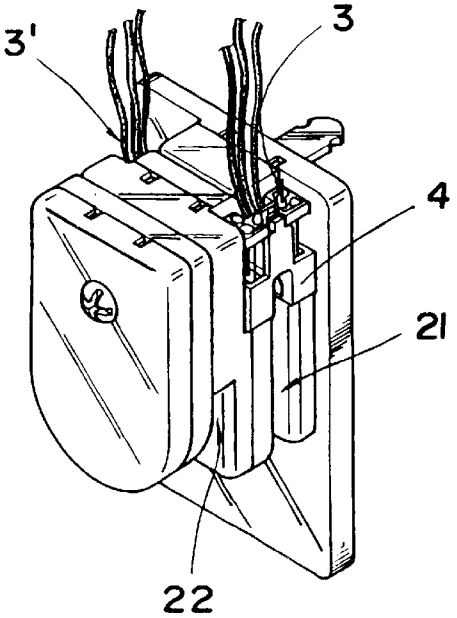
FIG. 5 is an assembled perspective of the present invention according to a preferred embodiment thereof.

Please refer to FIGS. 5 and 6 which are assembled and exploded perspective views, respectively, of the comparative type detecting means for a coin-collecting mechanism according to the present invention. As shown in the drawings, the comparative type detecting means of the present invention mainly includes a movable slot way portion 2 which has substantially similar structure to that in the conventional comparative type detecting means for a coin-collecting mechanism. That is, the movable slot way portion 2 has parallelly arranged and downward open first slot way 21 and second slot way 22 formed at lower part thereof, as well as main slide way 11 and secondary slide way 12 located below and aligned with the first and second slot ways 21, 22, respectively. However, the movable slot way portion 2 in the present invention is characterized by photoelectric cells or electric eyes 3 and 3' mounted thereto, such that the electric eyes 3, 3' and the movable slot way portion 2 can move synchronously.

More particularly, the electric eyes 3, 3' are fixedly mounted at a front and a rear end, respectively, of the first slot way 21 of the movable slot way portion 2 at predetermined positions. The electric eyes 3, 3' may be of any shape and can be mounted on the movable slot way portion 2 in any available and suitable manner. However, it is preferable that specially designed electric eye holders 4 are firstly connected to the movable slot way portion 2 at suitable positions, so that the electric eyes 3, 3' and any related components thereof can be conveniently set into the electric eye holders 4. The above-mentioned suitable positions for mounting the electric eyes 3, 3' are defined by a reference line passing an upper edge of the second slot way 22. However, the upper edge of the second slot way 22 is not a straight line but an obtuse angle about 160° for containing a sample coin therein. General coins have a diameter within the range from 18 mm to 31 mm. Basically, the second slot way 22 is designed to hold a sample coin of 25 mm in diameter. There is a very small distance between a top point of the sample coin and a top point of the obtuse angle of the second slot way 22. This distance keeps unchanged after the whole movable slot way portion 2 is formed. Thus, a line tangent to the top end of the 25 mmϕ sample coin in the second slot way 22 and parallel to a bottom surface of the secondary slide way 12, as the broken line shown in FIG. 7, can be taken as a reference line L. This reference line L is also parallel to a common plane between the main and the secondary slide ways 11, 12. If a smaller coin of 18 mm in diameter or a bigger coin of 31 mm in diameter in stead of the 25 mmϕ sample coin is disposed between the second slot way 22 and the secondary slide way 12, a minor distance about 0.2 mm will exist between the top point of the small or the big coin and the reference line L. This minor distance of 0.2 mm is still within the tolerance in examining diametrical size of the coin passing the comparative type detecting means. So long as the whole movable slot way portion 2 is unchanged in its structure, the position of the reference line L relative to the movable slot way portion 2 is unchanged, too. This means the electric eyes 3, 3' mounted on the movable slot way portion 2 of the comparative type detecting means based on the reference line L are located at fixed heights relative to the reference line L. Thus, when the electric eye holders 4 are mounted on the first slot way 21 with all possible manufacturing and/or assembling errors thereof kept within the tolerance of detection accuracy, the electric eye 3 which is mounted at front end of the first slot way 21 can be located at a position about 0.25 mm to 0.4 mm higher than the reference line L, and the electric eye 3' which is mounted at rear end of the first slot way 21 can be located at a position about 0.25 mm to 0.4 mm lower than the reference line L. When a factor of different diametrical size of coin is taken into consideration, the electric eyes 3 and 3' are preferably mounted at positions 0.4 mm higher and lower than the reference line L, respectively. That is, an accuracy in diametrical size examination by the comparative type detecting means is set to +/−0.4 mm. This means any coin inserted into the coin-collecting mechanism having a diameter larger or smaller than the sample coin by 0.4 mm will be detected and determined as unqualified coin. The coin will be rejected and the coin-operated machine associated to the coin-collecting mechanism can not be enabled.

When the sample coin is changed from a 25 mmϕ coin to a 31 mm ϕ coin, the reference line L previously defined according to a 25 mmϕ coin will obviously locate above the top point of the 31 mmϕ sample coin. As mentioned above, the distance between the reference line L and the top point of a bigger sample coin shall be within 0.2 mm, and the electric eyes 3 and 3' are preferably located away from the reference line L by 0.4 mm. Thus, when a sample coin of 31 mmϕ is used, any coin diametrically larger than the sample coin by 0.6 mm max. or diametrically smaller than the sample coin by 0.2 mm max. will be rejected by the comparative type detecting means of the present invention while the errors of 0.6 mm and 0.2 mm are still within the tolerance of the set detection accuracy. Similar principle is applicable to a sample coin diametrically smaller than 25 mm.

Figure 8:
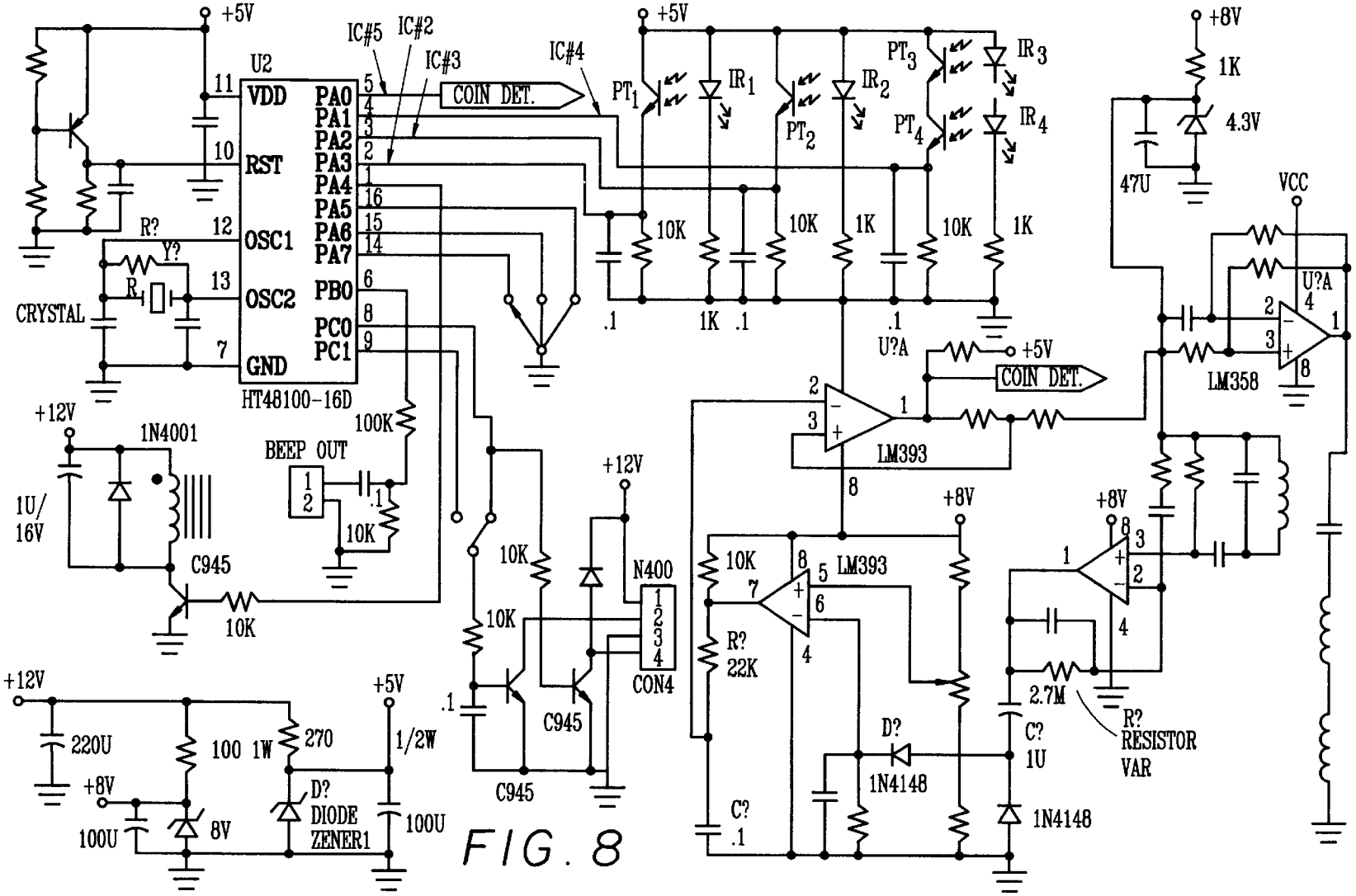
FIG. 8 is a preferred detecting circuit diagram for the present invention.

From the above description, it can be seen that the electric eyes 3, 3' are fixedly mounted on the first slot way 21 at heights and depths decided according to the reference line L. Since the second slot way 22 and the first slot way 21 are fixed parts of the movable slot way portion 2, the position of the second slot way 22 relative to the first slot way 21 is unchanged. When the second slot way 22 is slightly lifted away from the bottom surface of the secondary slide way 12 due to a diametrically bigger sample coin contained between them or is slightly lowered toward the bottom surface of the secondary slide way 12 due to a smaller sample coin contained between them, the positions of the first slot way 21 and accordingly, the electric eyes 3, 3' mounted thereon are synchronously adjusted. That is, the comparative type detecting means of the present invention can still function to check the material of any coin inserted into the coin-collecting mechanism while it has enhanced ability to accurately detect any inserted coin in incorrect diametrical size. The electric eyes 3, 3' cooperate with electronic circuits of the detecting means to perform the coin detecting function. Many different circuits can be designed to achieve this purpose. FIG. 8 is a preferred circuit diagram for the present invention. Following is a brief explanation of the circuit.

Figure 7:
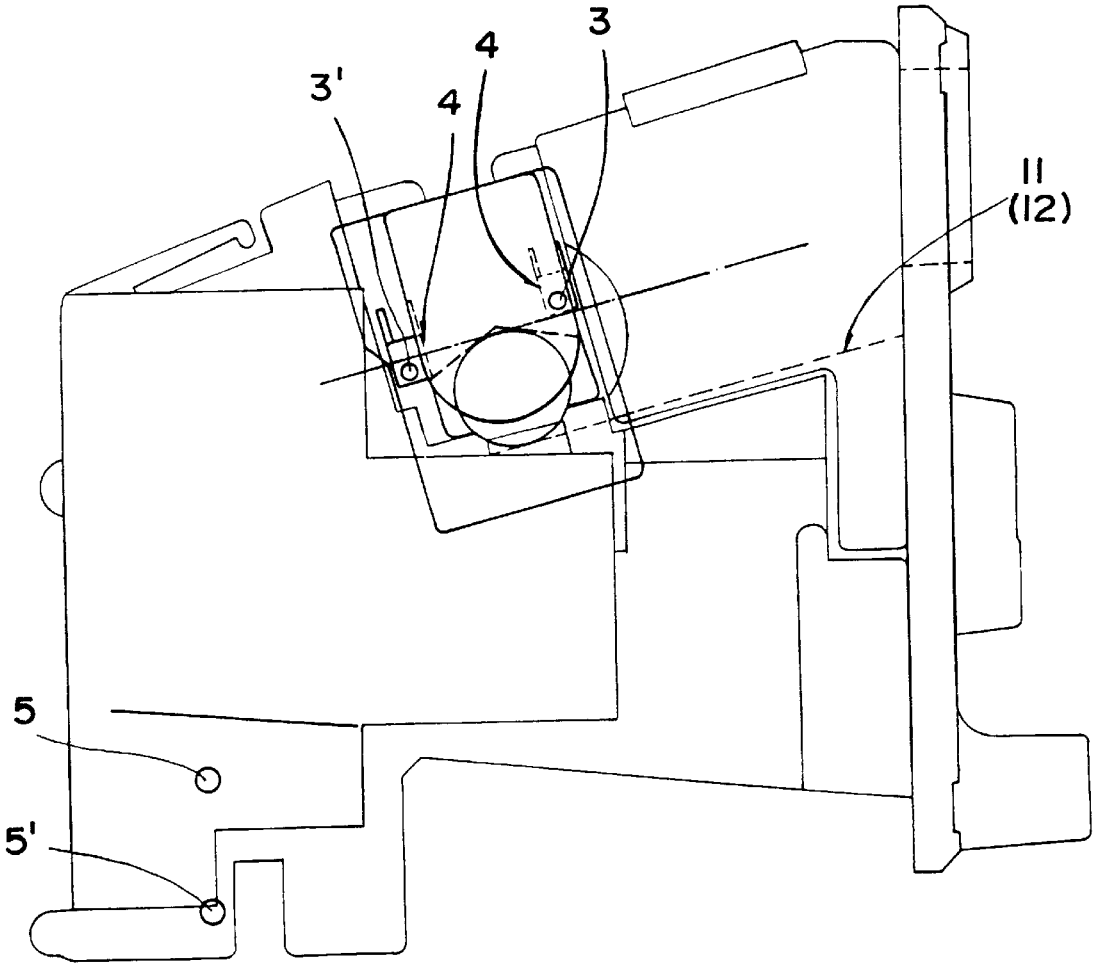
FIG. 7 is a schematic side view showing the position of the present invention in a coin-collecting mechanism.

According to this preferred circuit diagram, another two electric eyes 5 and 5' are provided at a gate at lower part of the coin-collecting mechanism to cooperate with the electric eyes 3 and 3' (see FIG. 7). In the circuit diagram of FIG. 8, IR1 PT1, IR2 PT2, IR3 PT3, and IR4 PT4 sequentially refer to the electric eyes 3', 5, 3, and 5'. The whole circuit is controlled by a CPU HT48/00-16D to achieve desired movements. The CPU is programmed to work in a fixed sequence. The sequence and any change of electric levels in the sequence under different operating conditions of the coin-collecting mechanism is explained as below:

1. Sequence and electric levels in a non-operating condition (that is, no coin is inserted):

| | | | |
|---|---|---|---|
| IC#2------> | IC#3------> | IC#4------> | IC#5 |
| H | H | H | H |

Sequences and electric levels in a normal coin-insertion condition:

| | | | |
|---|---|---|---|
| IC#5------> | IC#2------> | IC#3------> | IC#4 |
| H->L->H | H->L->H | H->L->H | H->L->H |

When the inserted coin is qualified:

| | | |
|---|---|---|
| IC#5------> | IC#2------> | Electromagnet at the |
| H->L->H | H->L->H | Gate is actuated. |

Then, cause:

| | | |
|---|---|---|
| IC#3------> | IC#4 | to complete the whole normal |
| H->L->H | H->L->H | operation. |

At this point, the coin-collecting mechanism sends out a signal to enable the coin-operated machine associated therewith.

2. When the inserted coin has the same material as that of the sample coin but is diametrically smaller than the sample coin, IC#5 changes while IC#2 keeps unchanged because the electric eye 3' (that is, IR1 PT1) is not blocked from light. This causes wrong sequence and the gate in the coin-collecting mechanism is not opened. The small coin is therefore rejected from a discharge slot of the coin-collecting mechanism. The detection is completed.

3. When the inserted coin has the same material as that of the sample coin but is diametrically larger than the sample coin, the electric eye 3 (that is, IR3 PT3) is blocked from light. Therefore, IC#4 changes first and it does not match with the programmed sequence. The IC does not function and the gate is not opened. The inserted coin is rejected from the discharge slot of the coin-collecting mechanism.

From the above explanation, it can be seen that the electric eyes 3 and 3' of the present invention may effectively enhance the ability of the comparative type detecting means of a coin-collecting mechanism in detecting coin in incorrect diametrical size.

What is claimed is:

1. A comparative type detecting means for a coin-collecting mechanism, comprising a movable slot way portion having parallelly arranged and downward open first and second slot ways provided at lower part of said movable slot way portion, as well as a main slide way and a secondary slide way located below and aligned with said first and said second slot ways, respectively; said second slot way and said secondary slide way together defining a space for positioning a sample coin therein, said first slot way and said main slide way together defining a passage for a coin inserted into said coin-collecting mechanism to pass therethrough; said movable slot way portion being provided at front and rear ends of said first slot way with an electric eye each, and said electric eyes being fixedly mounted on said movable slot way portion to move along with said movable slot way portion.

2. A comparative type detecting means for a coin-collecting mechanism as claimed in claim 1, wherein a line parallel to a bottom surface of said secondary slide way and tangent to a top point of said sample coin disposed between said second slot way and said secondary slide way is defined as a reference line for deciding mounting positions of said electric eyes on said movable slot way portion, such that one of said electric eyes is positioned higher than said reference line and another said electric eye lower than said reference line by a predetermined distance.

3. A comparative type detecting means for a coin-collecting mechanism as claimed in claim 2, wherein said predetermined distance respectively between said reference line and said electric eyes mounted at higher and lower positions determines a tolerable error in a diametrical size of a coin inserted to said coin-collecting mechanism when said coin is compared to said sample coin by said comparative type detecting means.

4. A comparative type detecting means for a coin-collecting mechanism as claimed in claim 2, wherein said second slot way has a top surface forming an obtuse angle and said sample coin contained between said obtuse-angled second slot way and said secondary slide way preferably has a diameter of 25 mm.

* * * * *